United States Patent [19]

Davis et al.

[11] 3,988,237

[45] Oct. 26, 1976

[54] INTEGRATED COAL HYDROCARBONIZATION AND GASIFICATION OF CHAR

[75] Inventors: Hubert Greenidge Davis, Charleston; Charles William Albright, S. Charleston; John Johnson Potter, Jr., St. Albans; Carl Edwin Strick, Charleston, all of W. Va.

[73] Assignee: Union Carbide Corporation, New York, N.Y.

[22] Filed: Dec. 27, 1974

[21] Appl. No.: 536,791

[52] U.S. Cl. ..... 208/8; 48/210

[51] Int. Cl.[2] ..... C10G 1/06

[58] Field of Search ..... 208/8; 48/197 R, 210

[56] References Cited

UNITED STATES PATENTS

| | | | |
|---|---|---|---|
| 2,634,286 | 4/1953 | Elliot et al. | 208/8 |
| 2,657,124 | 10/1953 | Gaucher | 208/8 |
| 2,676,908 | 4/1954 | Noel | 208/8 |
| 3,171,369 | 3/1965 | Stephens et al. | 110/28 |
| 3,347,647 | 10/1967 | Feldkirchner et al. | 48/197 R |
| 3,375,175 | 3/1968 | Eddinger et al. | 48/210 |
| 3,556,749 | 1/1971 | Spacil | 48/197 R |
| 3,755,137 | 8/1973 | Schuman | 208/10 |
| 3,817,723 | 6/1974 | Donath | 48/197 R |

*Primary Examiner*—Delbert E. Gantz
*Assistant Examiner*—James W. Hellwege
*Attorney, Agent, or Firm*—Israel Blum

[57] ABSTRACT

An integrated continuous process for the production of liquid and gaseous fuels wherein coal particles are hydrocarbonized with a hydrogen-rich gas supplied by a gasification process employing two separate and interconnected zones for combustion and gasification and wherein char produced by the hydrocarbonization of the coal particles provides the feed for the gasification zone.

14 Claims, 1 Drawing Figure

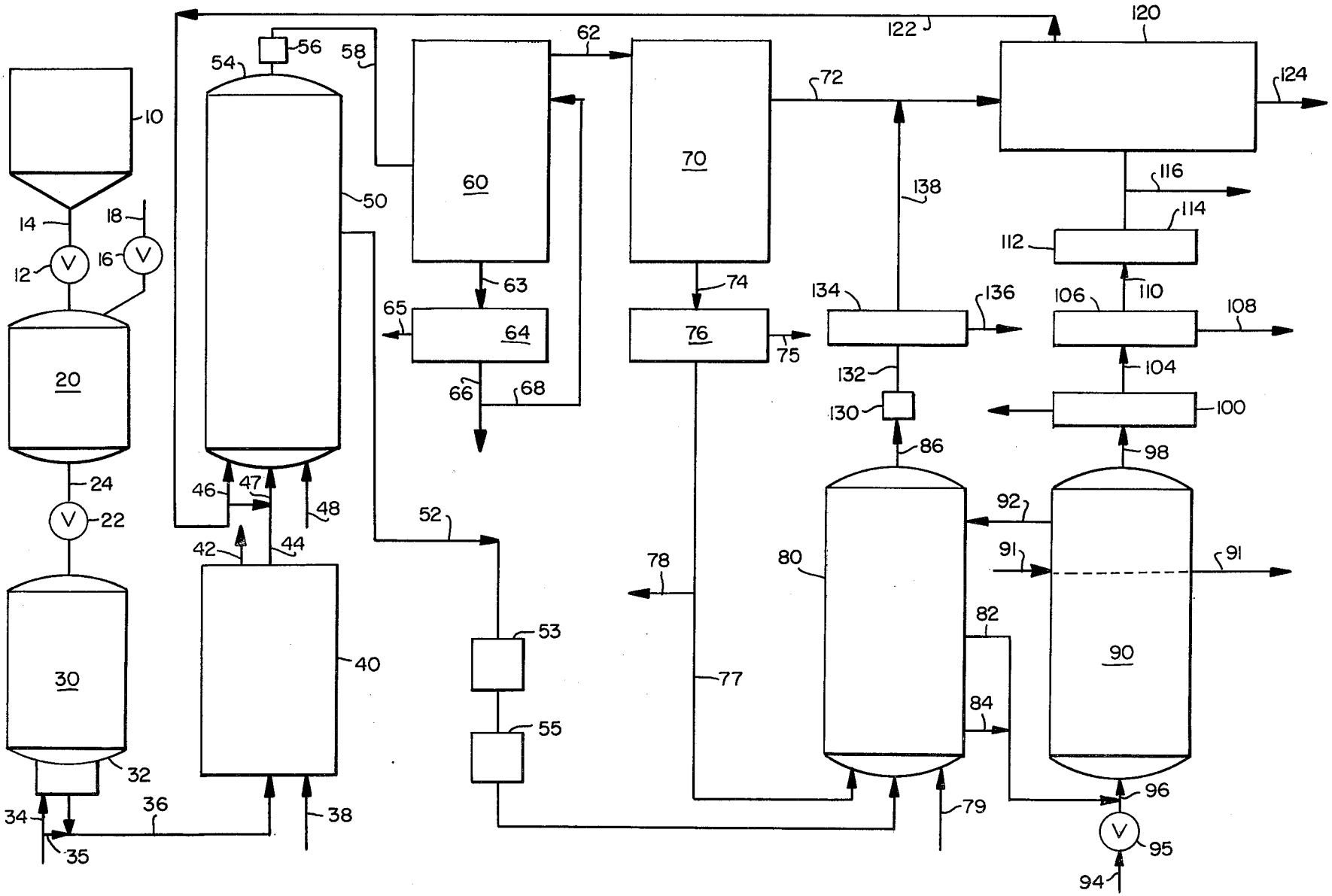
10
12
14
16
18
20
22
24
30
32
34
35
36
38
40
42
44
46
47
48
50
52
53
54
55
56
58
60
62
63
64
65
66
68
70
72
74
75
76
77
78
79
80
82
84
86
90
91
92
94
95
96
98
100
104
106
108
110
112
114
116
120
122
124
130
132
134
136
138

INTEGRATED COAL HYDROCARBONIZATION AND GASIFICATION OF CHAR

BACKGROUND OF THE INVENTION

1. Field of the Invention

This invention relates to an integrated and continuous process for producing gaseous and liquid products from coal wherein hydrogen is reacted with coal in a fluid bed hydrocarbonization zone to form char, gaseous and liquid products and wherein the char formed is fed to a fluid-bed gasification zone to generate all the hydrogen-rich gas required for the reaction with coal in the hydrocarbonization zone.

2. Description of the Prior Art

Increasing energy needs have focused attention on solid fossil fuels due to their availability in the United States in a relatively abundant supply and their potential value if converted into more useful forms of energy and feed-stock. Various processes have been developed in an effort to economically and efficiently convert coal to useful products.

In carbonization processes, coal has been coked in an inert atmosphere to produce about 10 to 15 weight percent, based in the coal charged, of a liquid product and about 70 to 75 weight percent of a solid char. The low yield and poor quality of these products rendered them commerically unattractive. The worth of the unit heating value of the solid char product, even with all the gas and liquid product, was less than that of the coal charged.

Hydrogenation processes have been employed to convert the bulk of the coal to a liquid product. In these processes, a recyclable pasting oil has been used to initially dissolve or slurry the raw coal; the slurry of coal and usually a catalyst in oil has been heated in the presence of hydrogen gas at 450° C to 550° C and about 2000 to 10,000 psig.; and up to 20 to 30 percent of the finely-divided unreacted coal and ash had to be filtered off or otherwise removed from the heavy, viscous primary oil product. Although these processes have been successful in that the amount of liquid products substantially increased, they were not commercially acceptable because the investment, the operating costs and in particular, the hydrogen requirements, were too high in comparison with the value of the products obtained. They are considered only in special economic conditions where alternate energy sources such as crude oil are expensive or unavailable. Other processes have been directed toward total gasification. However, total gasification requires large consumption of hydrogen as well as difficult and costly operating conditions.

Hydrocarbonization processes wherein coal has been carbonized in the presence of hydrogen have been employed to obtain gaseous and liquid products. However, these processes generally have been batch-type processes and not convertible to operable continuous processes in any obvious manner. It is shown in U.S. Pat. No. 3,231,486 that a sub-bituminous coal, Elkol coal, may be carbonized under mild operating conditions in the presence of hydrogen in a fluid-bed. And in U.S. Pat. No. 2,634,286, it is taught that char particles formed in a dry hydrogenation zone, which zone is maintained under a pressure of from 250 to 1500 lbs. per sq. in., may be employed to produce a high grade synthesis gas when passed directly to a gasification zone maintained under a pressure of from about 300 to 600 lbs. per sq. in. However, an effective, economical and continuous method of producing gaseous and liquid fuel products from coal remains an important national objective.

SUMMARY OF THE INVENTION

It is an object of this invention to provide a process for producing gaseous and liquid fuel products from coal in an efficient, economical and continuous manner. Another object of this invention is to provide unusual benefits by integrating a gasification process with a hydrocarbonization process. Still another object of this invention is to provide a process whereby a char by-product may be gasified at elevated pressures to generate the hydrogen necessary for maintaining fluidization and reaction within a hydrocarbonization zone.

This invention is based on the discovery that a hydrocarbonization process, disclosed in a concurrently filed application, "Process for the Continuous Hydrocarbonization of Coal" by C. W. Albright and H. G. Davis, can be integrated with a gasification process such as the one disclosed in U.S. Pat. No. 3,171,369 to result in exceptional benefits. In the hydrocarbonization process disclosed in the above-identified application, coal particles are preheated in dense phase flow, introduced at a high velocity in an essentially vertically upwards direction into the lower portion of a fluid-bed hydrocarbonization zone and reacted with hydrogen to produce char, gaseous and liquid products. The reaction is conducted at a temperature of about 480° C to about 600° C, a hydrogen partial pressure of from about 100 p.s.i. to about 1200 p.s.i. and an average solids residence time of about 5 to about 60 minutes. The reaction is conducted in a fluidized bed comprising coal and the process residue, char, fluidized by a gas. Hydrogen or a hydrogen-rich gas is used as the fluidizing gas.

U.S. Pat. No. 3,171,369 discloses a process for burning and gasifying carbonaceous solid particles in two separate and interconnected zones. The particles are introduced into a combustion zone and immediately combusted with air to form ash particles. These hot, fine, ash particles are accreted to larger ash particles in the bed, which larger particles are maintained at such a temperature that they have a slightly tacky or a sticky surface. An essentially carbon-free agglomerated ash is withdrawn from the combustion zone and fed to a fluid-bed gasification zone. Also an essentially solids-free gas is withdrawn from the combustion zone. Carbonaceous solid particles are introduced into the gasification zone which is fluidized by steam. The heated agglomerated ash particles from the combustion zone descend in the gasification zone and transfer their sensible heat to the fluid-bed of carbonaceous particles and to the steam in the gasification zone, thereby supplying the heat necessary for the gasification reaction. Gasification of the carbonaceous solid particles occurs at a temperature between about 800° C and about 1000° C and combustion at a temperature between about 1000° C and about 1200° C. Carbonaceous solid particles from the gasification zone are recycled to the combustion zone. The gasification and combustion zones may operate at elevated pressures.

It has now been found that such a hydrocarbonization process can be symbiotically integrated with an agglomerating ash gasification process such as described in U.S.. Pat. No. 3,171,369, to provide beneficial and unique couplings in the use of heat, wastewater and in the reduction of gas separation and clean-up costs. Contaminated wastewater from the hydrocarbonization step may be effectively used in the gasification step. Gas separation of product gases from both hydrocarbonization and gasification may be combined into one step. Waste heat from gasification may be applied economically to preheat feed streams to the hydrocarbonizer. These and other symbiotic benefits will become clearer from the description of the invention in detail in connection with the accompanying drawings.

FIG. 1 represents a semi-diagrammatic view of an arrangement of apparatus suitable for carrying out the process of this invention.

According to the process of this invention, feed coal is in particulate form, having been crushed, ground, pulverized or the like to a size finer than about 8 Tyler mesh, and preferably finer than about 20 Tyler mesh. Furthermore, while the feed coal may contain adsorbed water, it is preferably free of surface moisture. Coal particles meeting these conditions are herein referred to as fluidizable. Any such adsorbed water will be vaporized during preheat. Moreover, any such adsorbed water must be included as part of the inert carrying gas and must not be in such large quantities as to give more carrying gas than required.

Coal supply vessels 10 and 20 each can hold a bed of fluidizable size coal particles, which are employed in the process. Coal supply vessel 10 is typically a lock-hopper at essentially atmospheric pressure. Coal supply vessel 20 is typically a lock-hopper in which fluidized coal can be pressurized with process gas or other desired fluidization gases.

Operation of vessels 10, 20 and 30 can be illustrated by describing a typical cycle. With valves 16 and 22 closed, lock-hopper 20 is filled to a predetermined depth with coal from lock-hopper 10 through open valve 12 and line 14 at essentially atmospheric pressure. Then, with valves 12 and 22 closed, lock-hopper 20 is presssurized to a predetermined pressure above reaction system pressure through open valve 16 and line 18. Valves 12 and 16 are then closed and coal is introduced into fluidized feeder vessel 30 through open valve 22 and line 24. The cycle about lock-hopper 20 is then repeated. A typical time for such a cycle is from about 10 to about 30 minutes. With valve 22 closed, fluidized coal is fed at a predetermined rate through line 36 to the downstream process units.

Other variations of the feeding cycle to the fluidized feeder are possible, of course, but they are not illustrated herein since they do not form the inventive steps of the process. For example, a solids pump, such as described in U.S. Pat. No. 3,400,985 may be substituted for the lock-hopper. Using a solids pump, the coal may be pressurized with a suitable carrying gas such as recycle gas from the hydrocarbonizer or make-up hydrogen and fed intermittently to a pressure vessel such as fluidized feeder 30.

In fluidized feeder 30, a fluidizing gas passes through line 34 at a low velocity sufficient to entrain the fluidizable coal and convey it in dense phase flow through line 36 and into the bottom of coal preheater 40, or directly to line 44 if no preheat is required. Alternately, additional gas could be added through line 35 to line 36 to assist in conveying the coal in dense phase flow. Any non-oxidizing gas may be used as the fluidizing gas, e.g. fuel gas, nitrogen, hydrogen, steam or the like. However, it is preferable, in general, to use reaction process gas or recyle product gas. By dense phase as employed throughout the specification is meant a concentration of solids in fluidizing gas of from about 5 pounds to about 45 pounds of solids per cubic foot of gas, more typically from about 15 pounds to about 40 pounds of solids per cubic foot of gas.

Coal preheater 40 is a means to rapidly preheat when desirable the finely-divided coal particles, under fluidized conditions, to a temperature below the minimum temperature for softening or significant reaction range, in the substantial absence of oxygen. The maximum allowable temperature of heating is in the range of about 300° C to about 420° C. The stream of gas-fluidized coal in dense phase is heated upon passing rapidly through the heater having a favorable ratio of heating surface to internal volume. The coal is heated in the heater 40 to the desired temperature by any convenient means of heat exchange, e.g. by means of radiant heat or a hot flue gas such as depicted in FIG. 1 as entering the bottom of heater 40 through line 38 and exiting at the top of the heater 40 through line 42.

When a direct fired preheater is used, it may be heated by combustion of a small portion of the char from the hydrocarbonization reactor 50 or of the char purge from the gasifier vessel 80 or by combustion of a waste gas stream or a small portion of product gas. It is, however, more beneficial to indirectly preheat by means of a hot flue gas as depicted in FIG 1 entering heater 40 through line 38, the flue gas being obtained from combustion vessel 90 or the power recovery unit 106.

The temperature to which the coal may be preheated is related to the amount of sensible heat which must be added to the reactor 50 for the reactor to run adiabatically. On the high side, it is limited by the temperature at which the coal begins to soften and become sticky or the temperature at which significant volatilization takes place. This depends on the properties of the particular coal feed, but generally an upper limit of between about 300° C and about 420° C may be expected. Additional sensible heat, as needed, may be introduced into the reactor vessel 50 by preheating the fluidization gases, for example, either the recycle or the make-up hydrogen or both. It is more beneficial to use waste heat in flue gases from units 90 or 106 for this purpose.

Preheated, fluidized coal particles exit preheater 40 through line 44 and enter reactor 50 which is essentially vertical and ordinarily a cylindrical vessel. According to this invention, the coal particles are introduced into the lower portion of the fluid-bed reaction zone within reactor 50 through one or more inlets situated in the lower part of reactor 50. Preferably, the inlets are situated in the base of reactor 50 near the intersection of the base by the vertical axis of reactor 50.

In reactor 50, the natural circulation of coal particles within the fluid-bed reaction zone is a complex flow pattern. However, it may be described approximately by dividing the reaction zone into two concentric sub-zones, an inner sub-zone and an outer sub-zone surrounding the inner sub-zone. In the inner sub-zone which is situated substantially within the axially central portion of reactor 50, coal particles flow in a generally ascending path. In the outer sub-zone which is situated substantially near the walls of reactor 50, coal particles flow in a generally descending path. Advantages of introducing the coal particles into the fluid-bed into the lower portion of reactor 50 in an essentially vertically upwards direction are that the natural circulation of coal particles in the fluid-bed is enhanced and that the coal particles get at least a minimum residence time. Introduction of coal particles in this manner into the fluid-bed of reactor 50 promotes a channeled circulation of particles within the reaction zone along the natural circulation path. Circulation eddies, are thus enhanced and promote the dispersion of the entering coal particles with a matrix of non-agglomerating particles within the fluid-bed reaction zone.

The fluidized coal particles should be introduced into this inner sub-zone, the central upflow zone within reactor 50. The central upflow zone extends radially from the vertical axis of reactor 50 to an area where the outer sub-zone, the peripheral downflow zone begins. It is essential that the coal particles be introduced into the central upflow zone in order to avoid striking the walls of reactor 50 or entering the peripheral downflow zone. Preferably, the coal particles are introduced through the base or bottom of reactor 50 at one or more inlets situated in the vicinity of the point where the vertical axis of the reactor 50 intersects the base of reactor 50.

According to the process of this invention, the coal particles are introduced into the fluid-bed of reactor 50 at a high velocity as taught in a concurrently filed application, "Method of Avoiding Agglomeration in Fluidized Bed Processes" by C. W. Albright and H. G. Davis. "Introduction velocity" as used throughout the specification means the velocity of carrying gas through a device which causes the solids or liquid velocity to approach the maximum theoretcial ratio to gas velocity, i.e., 1 to 1. This high velocity may be achieved by accelerating the coal particles to the desired velocity along a constricted path of confined cross-section. A nozzle, narrow inlet port, tapered channel, or any inlet means which narrow, constricts or necks down the cross-sectional area of the inlet where the fluidized coal particles enter reactor 50 may be used to accelerate the particles to the desired velocity. The stream of preheated, fluidizable coal particles is introduced into the lower portion of the fluid-bed of the reactor 50 at a high velocity in an essential vertically upwards direction.

An inlet means such as a nozzle which comprises a transfer line having a reduced or constructed cross-sectional area may be employed in the method of this invention. The length to cross-sectional area ratio of the nozzle should be sufficiently large enough so that the desired velocity of injection for the solid coal particles or non-vaporizable recycle oil may be achieved. A length to cross-sectional area of this section of transfer line of greater than about 5 to 1 is desirable, greater than about 10 to 1 preferable. This allows for a finite distance which the coal particles and/or vaporizable recycle oil require for acceleration to the velocity approaching that of the carrying gas.

Introduction of the coal particles through line 44 through the bottom of the reaction vessel 50 at a high velocity prevents agglomeration of the fluidized bed at the elevated temperatures required for reaction within the reaction vessel 50. Coal particles, especially caking, swelling or agglomerating coals, become sticky when heated in a hydrogen-rich atmosphere. Even non-caking, non-swelling and non-agglomerating coals become sticky when heated in such an atmosphere. The stickiness results due to a tarry or plastic-like material forming at or near the surface of each coal particle, by a partial melting or decomposition process. On further heating over a time period, the tarry or plastic-like material is further transformed into a substantially porous, solid material referred to as a char. The length of this time period, generally in the order of minutes, depends upon the actual temperature of heating and is shorter with an increase in temperature. By plastic transformation as used throughout the specification is meant the hereinabove described process wherein surfaces of coal particles being heated, particularly when heated in a hydrogen atmosphere, develop stickiness and transform into substantially solid char, non-sticky surfaces. "Plastic transformation" is undergone by both normally agglomerating coals and coals which may develop a sticky surface only in a hydrogen-rich atmosphere.

Agglomerating or caking coals partially soften and become sticky when heated to temperatures between about 350° C to about 500° C over a period of minutes. Components of the coal particles soften and gas evolves because of decomposition. Sticky coal particles undergoing plastic transformation tend to adhere to most surfaces which they contact such as walls or baffles in the reactor, particularly relatively cool walls or baffles. Moreover, contact with other sticky particles while undergoing plastic transformation results in gross particle growth through adherence of sticky particles to one another. The formation and gorwth of these agglomerates interferes drastically with the maintenance of a fluid-bed and any substantial growth usually makes it impossible to maintain fluidization.

In particular, entrance ports and gas distribution plates of equipment used in fluid-bed coal conversion processes become plugged or partially plugged. Furthermore, even if plugging is not extensive, the sticky particles tend to adhere to the walls of the vessel in which the operation is conducted. Continued gross particle growth and the formation of multi-particle conglomerates and bridges interferes with smooth operation and frequently results in complete stoppage of operation.

Agglomeration of coal particles upon heating depends on operating conditions such as the heating rate, final temperature attained, ambient gas composition, coal type, particle size and total pressure. When heated in a hydrogen atmosphere, even non-agglomerating coals, such as lignites or coals from certain sub-bituminous seams, are susceptible to agglomeration and tend to become sticky in a hydrogen atmosphere. Thus, agglomeration of coal particles is accentuated in a hydrocarbonization reactor where heating in the presence of a hydrogen-rich gas actually promotes formation of a sticky surface on the coal particles reacted. However, in the process of this invention, agglomeration of the coal particles is prevented by introducing them into the hydrocarbonization zone of the reaction vessel 50 at a velocity sufficient to rapidly and uniformly disperse them at a temperature below the plastic transformation-temperature within a matrix of non-agglomerating particles in the fluid-bed hydrocarbonization zone. These non-agglomerating particles comprise the hot partially reacted coal particles and char particles situated within the fluid-bed hydrocarbonization zone at the reaction temperature.

According to the process of this invention, the fluidized stream of coal particles enter the fluid-bed hydrocarbonization zone within a vertically elongated reaction vessel at a velocity of more than about 200 feet per second, preferably more than 400 feet per second, in a manner described hereinabove in order to substantially prevent agglomeration of the fluid-bed. "Hydrocarbonization zone" as used throughout the specification is meant to include that area wherein carbonaceous, combustible, solid and sometimes liquid particles, are reacted with hydrogen to form char, liquid and/or vapor fuel products in hydrocarbonization. Other devices or techniques well-known in the art of fluidization may also be used in combination with this process to prevent agglomeration such as reactor internals which improve circulation of the fluid-bed, an oxidization step or an external recycle of char from the reactor or the like.

The fluid-bed hydrocarbonization zone within the reactor 50 is fluidized with a hydrogen-rich recycle gas through line 46. Moreover, it may be desirable to use some of this hydrogen-rich recycle gas to increase the velocity of the particles entering the reactor 50 through line 44. Line 47 is employed to bring hydrogen-rich recycle gas into line 44 for this purpose. By a hydrogen-rich gas is meant a gas containing more than about 20 percent hydrogen, preferably between about 30 percent and about 98 percent hydrogen, and most preferably between about 80 percent and about 98 percent hydrogen. Lesser percentages of hydrogen may be used but result in inefficiencies because of the large volume of gas flow required for hydrocarbonization and the subsequent removal costs to separate the non-hydrogren containing unreacted gases.

Recycle liquid can also be fed into reactor 50 through line 48. Injection of the recycle is also preferably at a velocity of about 200 feet per second or greater, and more preferably about 400 feet per second or greater, into the zone of central upflow within the fluid-bed reaction zone through the lower end of reactor 50 in an essentially vertical direction. The recycle liquid injected in such a manner follows a substantially ascending path about a substantially axially central portion of the reaction vessel. In the injection of the recycle oil and fluidizable coal particles, it is essential that they be introduced into the reactor vessel in such a way that they do not immediately and directly strike the walls of the reactor vessel, a result which would lead to unnecessary and undesirable agglomeration.

Only one inlet each for entry of the preheated coal particles and the recycle liquid is shown in FIG. 1. These inlets may represent, however, a multiplicity of inlets for ease of operation of this process. A multiplicity of inlets may be desirable, for example, where the reactor is large, or when separate recycle streams of liquid being injected into the reactor. The entry points for the coal particles and/or recycle oil are preferably situated about the axially central portion of the reactor bottom. Each stream of coal particles and/or recycle liquid is preferably introduced at a high velocity at each inlet in an essentially vertically upwards direction; the inlets are situated in the lower portion of the reactor substantially in the vicinity of the vertical axis at or near the reactor bottom. In this manner, the separate streams of entering carbonaceous materials are kept separate and apart until rapidly mixed in the fluid-bed with partially reacted coal and char particles.

Liquid and vapor products are removed from the reactor vessel 50 through line 54. Fluidization gas is fed into the reactor vessel 50 through line 46, the gas being a hydrogen-rich, substantially oxygen-free gas. The hydrogen-rich, substantially oxygen-free gas used to fluidize the fluid-bed reactor 50 is made in gasifier 80 and may in addition be obtained from hydrogen-containing recycle gases. A fluidization velocity of about 0.1 to about 2 feet per second is preferred. Lower fluidization velocities would result in a reactor of undesirable proportions having a diameter far exceeding its height in order to maintain the residence time desired in the process of this invention. Furthermore, lower fluidization velocities would tend toward agglomeration of the coal particles within the hydrocarbonization zone.

In the reactor 50, a portion of the hydrogen is consumed and the coal feed reacts with hydrogen to form gaseous, liquid and solid products at a temperature of about 480° C to about 600° C, a hydrogen partial pressure of from about 100 p.s.i. to about 1200 p.s.i. and an average solids residence time of about 5 minutes to about 60 minutes. The gas contains methane, ethane, propane, butane, some olefinic $C_2 - C_4$, carbon monoxide, carbon dioxide and sulfur compounds, mainly $H_2S$. The gas product is, of course, mixed with unreacted hydrogen. The liquid, defined as all material boiling at a temperature greater than about 25° C, contains light hydrocarbons such as benzene and methylcylopentane, phenolics such as phenol and cresols, distillates in the naphtha, atmospheric and vacuum gas oil ranges and residual materials.

The distribution among these products, both in gas and in liquid, depends upon the nature of the coal feed and/or the reaction conditions. By varying hydrogen partial pressure, temperature, fluidization velocity, coal residence time and hydrogen consumption, we can vary the proportion of products in gas and in liquid and the distribution of components within the gas and liquid. For example, liquid product is maximized with respect to gas at low temperature, high fluidization velocity and low hydrogen consumption. At higher temperatures, higher hydrogen consumptions and by use of a liquid product recycle, gas product yield can be increased at the expense of liquid yield.

Gas and vaporized liquid products from reactor 50 pass overhead through line 54 and are cleaned of solid carry-over by cyclone 56 and if necessary, back-up filters or the like. From cyclone 56, the products from hydrocarbonization pass through line 58 into fractionating tower 60. Tower 60 may be operated to pass near the top through line 62 all lighter gases and liquid products boiling up to about 200° C, including gasoline hydrocarbons. Higher boiling liquids such as heavy oil may be removed by way of line 63 and cooled in heat exchanger 64 which makes steam. Such product steam may be withdrawn from line 65. The cooled higher boiling liquid may be withdrawn through line 66 and sent to an oil storage unit (not shown) or recycled through line 68 into tower 60 or directly into product stream 58 to assist in further separation, operating to quench the product stream 58 to a lower temperature to allow the resulting gas-liquid mixture to pass overhead through line 62 as described above and the heavier oil to pass through line 63 at the bottom.

The gases and low boiling products mixture are removed from tower 60 through line 62 and pass into tower 70 which is a gas-liquid condenser and separator from which the condensed aqueous liquid and the condensed liquid products rich in gasoline hydrocarbons are removed through the bottom via line 74, and the gases through line 72. The condensed liquid products pass through line 74 into phase separator 76. Light oils are removed via line 75 to storage or may be recycled to tower 60 to provide a reflux from separator 76 and an aqueous liquor product is withdrawn via line 77. Gas products are conveyed to gas treatment plant 120 via line 72 where such components as $CH_4$, CO, $C_2$–$C_5$, $H_2$ and $CO_2$ are separated to leave a residual gas comprising essentially hydrogen and carbon monoxide. Using the well-known water-gas shift reaction, the carbon monoxide of the residual gas may be converted to additional hydrogen and carbon dioxide which may be readily eliminated to yield hydrogen of a desirable purity, typically 96% of volume of hydrogen.

Water product is recovered in separator 76 via line 77 under such conditions as to limit contamination with, for example, phenols and nitrogen bases formed from coal feed. However, even under such conditions, a significant amount of water contamination may be expected. Costly cleanup may therefore be unavoidable before reuse or disposal of this water via line 78. On the other hand, water itself may be at times a valuable commodity limited in supply. In the integrated process of this invention, it has been found that this contaminated water can be used directly to supply reaction steam for the char gasifier 80. This steam can be raised externally in a boiler capable of handling a contaminated water or may more preferably be raised directly in the gasifier as illustrated in FIG. 1 by injection of the liquid water through line 77 directly into the gasifier 80. The heat of the gasifier 80 instantaneously converts the water into steam for use in the gasification reaction.

The hot char product is removed from reactor 50 via line 52 in a dense phase, fluidized stream to gasifier 80. The gasifier pressure is the same or preferably slightly lower than the pressure in the hydrocarbonization reactor 50. Char products drop from reactor 50, and may employ blowback of steam to fluidize the char, into intermediate storage vessel 53 which feeds a fluidized feeder 55 similar to fluidized feeder 30. Part or all of the steam is preferably generated in situ by injection of a small amount of liquid water which also serves to partially quench char to a temperature at which hot valves are operable and evolution of tars essentially ceases. The char produced is maintained hot and fluidized, preferably employing a small amount of steam. Then the hot char is carried with steam for injection into gasifier 80 via line 52.

A preferred method of transferring the char particles from the hydrocarbonization zone to the gasification zone is by the use of lock-hopper vessel 53 and fluidized feeder 55 each equipped with the necessary pressure locks. Other conventional solids transferring means may also be employed if desired in passing the char particles from the hydrocarbonization zone to the gasification zone.

The average residence time in the preferred dry-feeding system comprising vessel 53 and feeder 55 is between about 15 and about 60 minutes. It is desirable to lower the temperature of the char particles to a temperature below about 400° C, and preferably to a temperature between about 300° C and about 400° C in order to minimize valve problems associated with the high pressure, solids handling valves (not shown) required for pressurization. The temperature of the char particles is preferably lowered rapidly by quenching to a level where continuous operation of valves is possible and devolatilization is negligible. It may be desirable to lower the temperature of the char particles to between about 300° C and about 400° C when valve limitations are not a problem. Quenching may be accomplished, for example, by injecting liquid water into line 52 at one or more points where the char product is withdrawn from reactor 50.

A major benefit of coupling the gasification step of this invention with the hydrocarbonization step is that cooling is limited to the minimum necessary to permit handling and pressurizing, etc. char product from reactor 50 in the char receiver 53 and transfer line 52. Another major benefit is that regrinding of the char before gasification is unnecessary. The cooling step is minimized and the regrinding step is avoided. Such regrinding is, for example, required if gasification is carried out in a gasifier such as employed in many other gasification processes. Much of the sensible heat of the product char which would have been lost during these additional steps is thus recovered and the energy and other costs of regrinding are avoided.

The gasifier 80 operates at a pressure substantially equal to or slightly less than the pressure of the hydrocarbonizer 50. Preferably, the hydrocarbonizer 50 operates at a pressure about 5 to 250 p.s.i. higher than the gasifier 80. A feature of operating the gasifier near the relatively high pressure of the hydrocarbonizer is that the product gases will contain much methane. Such feature makes it possible to advantageously combine certain gas separation and clean-up steps employed for the hydrocarbonizer and gasifier gas products in the process of this invention. Such combined steps reduce costs and increase the overall efficiency of this process.

In gasifier 80, contaminated water product, hot char and steam may be introduced via line 77, 52 and 79, respectively. Since char is non-agglomerating, coal gasification takes place without agglomerating difficulties and the operation is smoother than that of a non-integrated coal gasification process. Heat for the reduction of char and steam is supplied by hot agglomerated ash particles introduced into gasifier 80 from combustor 90 via line 92.

Gasifier 80 is a bottom-fed fluidized reactor. Char from the hydrocarbonization reactor 50 is introduced near the base of the reactor 80 into the fluidized bed of hot sintered ash agglomerates. These hot ash agglomerates circulate continuously through the gasification reaction zone to furnish the sensible heat required for the gasification reaction. The hot ash agglomerates which enter gasifier 80 via line 92 from the agglomerating ash combustor 90 are recycled to the combustor 90 through line 84 after delivering their sensible heat. The char particles, which are both smaller in size and lower in density than the ash agglomerates, ascend through the fluid-bed which the denser ash agglomerates descend and are withdrawn at the bottom. The bed is fluidized by steam from line 79 and/or contaminated water from line 77 which immediately is converted to steam by the heat within the gasification zone.

As indicated herein, steam may be obtained through a number of means in the process of this invention. For example, the steam which may be fed into gasifier 80 through line 79 may be obtained by conveying water through line 91 which extends through combustor 90. Water passing through line 91 is converted to steam by heat transfer provided by the combustion reaction in combustor 90.

In flowing up through the hot agglomerates, char partially reacts with steam at an elevated temperature between about 800° C and about 1000° C and pressure of from about 100 p.s.i. to about 1200 p.s.i. in the fluid-bed, to produce a gaseous product rich in hydrogen which is withdrawn through line 86 and a modified char residue which is removed through line 82.

Such ungasified char residue is withdrawn continuosly through line 82 and cycled through line 96 into the combustor 90 for combustion with an oxygen-containing gas, preferably air fed into the combustor via line 96. Line 94 is employed to feed the oxygen-containing gas through compressor 95 for pressurization into line 96. Combustion of the modified char residue with the oxygen yields hot ash agglomerates which are withdrawn through line 92 for use in the gasifier. Moreover, the combustion occurs under conditions which result in gaseous products that are essentially free of entrained solids. The char particles burn at elevated temperatures between about 1000° C and about 1200° C under near slagging conditions and agglomerate onto cooler large circulating agglomerates producing an essentially ash-free flue gas. Most ash remains as agglomerates in the combustion bed and high efficiency cyclones effect almost total removal of the remainder.

Steam gasification of char products, after treatment, sufficient hydrogen-rich gas for recycle to continuously operate the hydrocarbonizer 50. In turn, the amount of char produced by the hydrocarbonization reaction provides not only sufficient char for the steam gasification reaction but a surplus amount which may be employed to produce steam or power for use in the integrated process and/or for export. Steam gasification of char at elevated pressures requires between about 25 percent and about 80 percent of the char provided by the hydrocarbonization reaction to form a product gas which in turn when treated sufficiently provides sufficient hydrogen for hydrocarbonization. This includes char burned in combustor 90 to supply heat for gasification. Moreover, at elevated pressures, a substantial amount of methane is also formed by steam gasification, between about 3 percent and 10 percent yield based on the original MAF coal fed to the hydrocarbonizer 50. The amount of char formed per amount of MAF coal hydrocarbonized may be varied between about 38 percent and 62 percent By varying operating conditions, energy requirements of the overall integrated processing may be met and numerous economies of operation achieved through a symbiotic coupling of the hydrogen generation units with the hydrogen consuming units.

Flue gas product of the combustion reaction is removed from combustor 90 through line 98 and passed into heat exchanger 100 for steam recovery via line 102. The flue gas product then is conveyed from the heat exchanger through line 104 to power recovery unit 106 which converts the heat and pressure energy to electric and/or mechanical power via line 108. The cooled flue gas exits the power recovery unit 106 through line 110 for sulfur dioxide removal in unit 112. Alternately, it may be desirable to partially cool the flue gas before power recovery, remove $SO_2$ and/or other contaminants, then reheat. The flue gases, now inert, may be used in another part of the integrated process if desired and are removed through line 114 or vented to the atmosphere through line 116.

Gaseous product from gasifier 80 is removed overhead through line 86 and passed through cyclone 130 for removal of solid carry over. From cyclone 130, the gaseous product is conveyed through line 132 into heat exchanger 134 for cooling and recovery of steam via line 136. The cooled gaseous product is withdrawn from the heat exchanger 134 through line 138 and joined to line 72 conveying the gaseous product from vapor-liquid separator 70 into gas treatment plant 120. Such a combination provides beneficial economies and simplifies the overall recovery system for this process.

In gas treatment plant 120, sulfur compounds (hydrogen sulfide) and $CO_2$ are removed. The mixed gases, still essentially at system pressure, are cooled by known gas-separation techniques and a $C_1$–$C_2$ split is made giving a $C_2$–$C_4$ concentrate as a separate product stream and a remaining crude hydrogen, carbon monoxide and methane mixture. By further cooling, a CO–$CH_4$ split is made to recover a methane product stream useful as 1000 BTU/CF pipeline gas. The remaining hydrogen-carbon monoxide stream then passes through a single-stage shift converter and a $CO_2$ removal, before exiting from the gas treatment plant through line 122 as a nearly pure hydrogen stream for recycle to such hydrocarbonizer 50. Such hydrogen-rich recycle gas comprises between about 80 percent and about 98 percent hydrogen, typically about 96 percent hydrogen. Other product gases as mentioned hereinabove are illustrated as exiting gas treatment plant 120 through line 124. The $C_2$–$C_4$ mixture hereinabove described may by use of additional columns be further separated into ethane, propane and butane streams. Minimal advantages are obtained in the gas treatment plant by combining acid-gas removal and water-gas shift steps for hydrogen recycle and make-up streams. The further advantages of combined separation of methane from $H_2$–CO streams and of separate recovery of $C_2$–$C_4$ stream should be employed as economics dictates.

What is claimed is:

1. In a process employing two separate and interconnected fluid-bed reaction zones, a first zone for gasification and a second zone for combustion of char particles; wherein in said first zone, char particles are gasified with stream at an elevated temperature and pressure between about 150 p.s.i. and about 1000 p.s.i. to produce modified char particles and a first hydrogen-rich gas product; wherein said second zone, said modified char particles from said first zone are burned with air at a temperature sufficient to produce tacky ash particles that accrete to larger ash particles; and wherein said larger ash particles from said second zone provide the heat required to effect the gasification reaction in said first zone by descending in said first zone and transferring their sensible heat to said char particles and said steam, the improvements which comprise providing the char particle feed for said gasification and combustion zones by the steps of:

a. fluidizing coal particles with a non-oxidizing gas to form a dense phase;

b. pressurizing said fluidized coal particles of step a with a hydrogen-rich gas;

c. preheating said coal particles in said dense phase in an essentially oxygen-free environment to a first predetermined temperature below a temperature at which said coal particles undergo plastic transformation.

d. providing a third fluid-bed reaction zone for hyrocarbonization at a second predetermined temperature between about 480° C and about 600° C, said third fluid-bed zone consisting essentially of a matrix of non-agglomerating coal and char particles at said second predetermined temperature fluidized by a hydrogen-rich, oxygen-free gas having a velocity between about 0.1 and about 2 feet per second;

e. continuously introducing said coal particles of step c and a hydrogen-rich, oxygen-free gas into the lower part of said third zone in an essentially vertically upwards direction, said coal particles having a velocity sufficient to rapidly and uniformly disperse, at said first predetermined temperature, within said matrix; said velocity being greater than about 200 feet per second.

f. continously providing said char particles for gasification in said first zone by reacting said coal particles of step *e* and a condensable vapor product, the hydrocarbonization being conducted at said second predetermined temperature, a hydrogen partial pressure of from about 100 p.s.i. to about 1200 p.s.i. and an average solids resident time of about 5 minutes to about 60 minutes;

g. continuously withdrawing said char particles at said reaction temperature and said condensable vapor product from said zone;

h. continuously introducing said char particles into said first zone for gasification with steam;

i. condensing the condensable vapor in said vapor product to recover a heavy oil boiling above about 200° C; and j. separating a light oil boiling above about 30° C and a second hydrogen-rich gas product from said vapor product.

2. A process as defined in claim 1 further including after step *g*, the step:

g. lowering the temperature of said char particles to a third predetermined temperature below about 400° C; and after step *j*, the steps:

k. continuously providing said steam for said gasification reaction in said first zone by separating water from said light oil and introducing said water into said first zone for instantaneous conversion into said stream; and m. continuously providing said hydrogen-rich, oxygen-free gas for use in said third zone by combining said first and a second hydrogen-rich gas products and separating an end product gas comprising a hydrogen-rich recycle gas from said combined gas product.

3. A process as defined in claim 2 wherein the pressure in said third zone is substantially equal to or greater than the pressure in said first zone.

4. A process as defined in claim 3 wherein the pressure in said third zone is about 5 p.s.i. to about 250 p.s.i. greater than the pressure in said first zone.

5. A process as defined in claim 1 wherein said first predetermined temperature is between about 300° C and about 420° C, and said matrix comprises partially reacted coal and char particles.

6. A process as defined in claim 5 wherein said gasification in said first zone is conducted at a temperature between about 800° C and about 1000° C, said combustion in said second zone is conducted at a temperature between about 1000° C and about 1200° C, and wherein said non-oxidizing gas in step *a.* is selected from the group consisting of fuel gas, nitrogen, hydrogen and steam.

7. A process as defined in claim 2 wherein in step *g*, said third predetermined temperature is between about 300° C and about 400° C.

8. A process as defined in claim 7 wherein in step e., said coal particles and hydrogen-rich, oxygen-free gas are introduced into said third zone through the substantially axially central portion of said lower part of said zone.

9. A process as defined in claim 8 wherein in step e. said velocity is more than about 400 feet per second.

10. A process as defined in claim 8 further including step e., introducing recycle oil along with said coal particles and said recycle oil velocity being substantially equal to said particle velocity; said hydrogen-rich, oxygen-free gas into said third zone and further including in step *f.*, reacting said coal particles and said recycle oil with hydrogen in said third zone.

11. A process as defined in claim 10 wherein said recycle oil velocity is more than about 400 feet per second.

12. A process as defined in claim 1 wherein in step *f.*, between about 25 percent and about 80 percent of the product char provided by the hydrocarbonization reaction in said third zone is employed in the gasification in said first zone.

13. A process as defined in claim 2 wherein in step *m.*, said hydrogen-rich recycle gas comprises between about 80 percent and about 98 percent hydrogen.

14. A process as defined in claim 13 wherein said hydrogen-rich recycle gas comprises about 96 percent hydrogen.

* * * * *

UNITED STATES PATENT OFFICE

CERTIFICATE OF CORRECTION

Patent No. 3,988,237 Dated October 26, 1976

Inventor(s) Hubert Greenidge Davis et al.

It is certified that error appears in the above-identified patent and that said Letters Patent are hereby corrected as shown below:

Column 13, line 31, claim 2, line 3, "g." should read -- g′. --.

Column 14, line 16, claim 7, line 1, "g," should read -- g′, --.

Column 14, line 26, claim 10, line 1, after "including" insert -- in --.

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*